United States Patent [19]

Kozak

[11] 4,024,687

[45] May 24, 1977

[54] ARCHITECTURAL SYSTEM HAVING POST-TENSIONED ELEMENTS

[76] Inventor: John Kozak, 323 Leax Lane, Turtle Creek, Pa. 15145

[22] Filed: June 26, 1975

[21] Appl. No.: 590,417

[52] U.S. Cl. ..... 52/228; 52/227; 52/236.3; 52/262; 52/602

[51] Int. Cl.[2] ..... E04C 3/10; E04C 3/26

[58] Field of Search ..... 52/262, 263, 227, 228, 52/602, 607, 236, 238, 503, 505, 300, 301

[56] References Cited

UNITED STATES PATENTS

| | | | |
|---|---|---|---|
| 1,690,259 | 11/1928 | Strauss | 52/602 X |
| 2,046,152 | 6/1936 | Dean | 52/301 |
| 3,090,165 | 5/1963 | Chiado | 52/602 |
| 3,260,025 | 7/1966 | Van Der Lily | 52/228 |
| 3,495,367 | 2/1970 | Kobayashi | 52/602 X |
| 3,562,978 | 2/1971 | Ali-Ogla | 52/263 X |
| 3,733,762 | 5/1973 | Pardo | 52/263 |
| 3,861,102 | 1/1975 | Hodge | 52/300 X |
| 3,903,667 | 9/1975 | Zetlin | 52/227 |
| 3,918,222 | 11/1975 | Bahramian | 52/263 X |

FOREIGN PATENTS OR APPLICATIONS

| | | | |
|---|---|---|---|
| 253,219 | 4/1960 | Australia | 52/228 |
| 577,633 | 6/1959 | Canada | 52/228 |
| 1,322,025 | 6/1963 | France | 52/238 |
| 1,083,109 | 1/1955 | France | 52/228 |
| 426,802 | 5/1924 | Germany | 52/263 |
| 429,472 | 8/1948 | Italy | 52/602 |

*Primary Examiner*—Price C. Faw, Jr.
*Assistant Examiner*—Leslie Braun
*Attorney, Agent, or Firm*—Donn J. Smith

[57] ABSTRACT

An architectural system comprises a number of free-standing wall modules of cruciform configuration, with each of the wall modules having a bearing surface adjacent the end of each of its arms. A square or rectangular supporting beam arrangement or network is disposed with each of its corners engaging one of the bearing surfaces. A floor/ceiling module is supported on the beam arrangement. The cruciform wall modules are oriented and spaced from one another to define a floor area extending therebetween and having its perimetric edges angularly displaced about 45° relative to the perimetric edges of the beam network such that the floor area is substantially wider than the length of one of the beam segments comprising the beam network.

15 Claims, 9 Drawing Figures

Fig. 1.
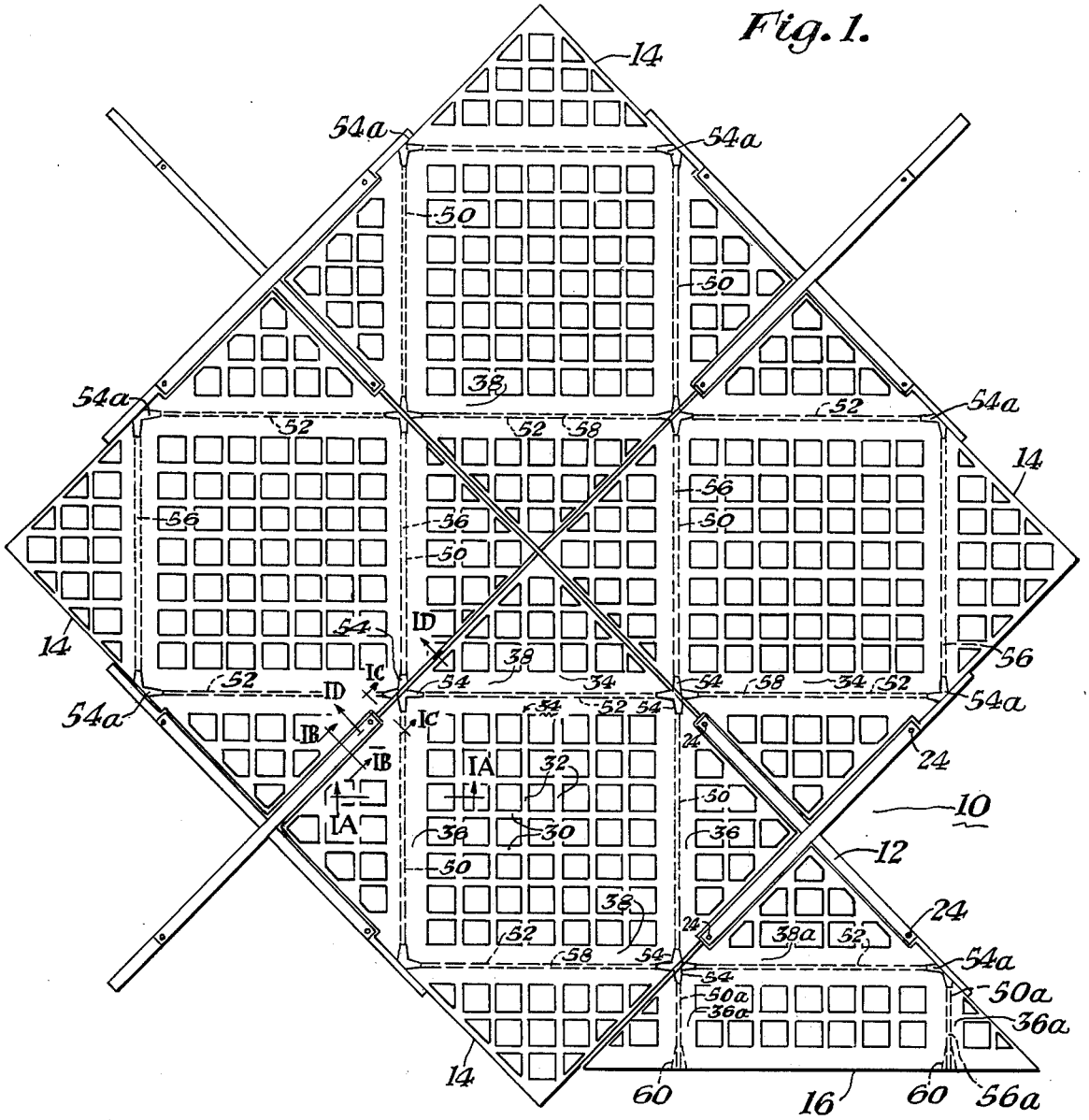
Fig. 1A.
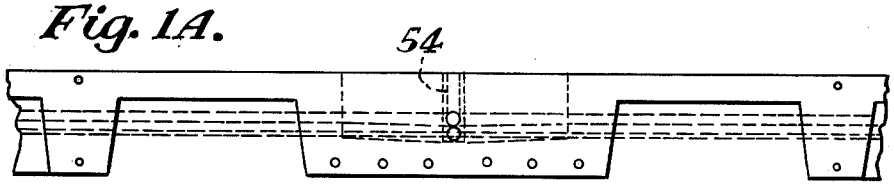
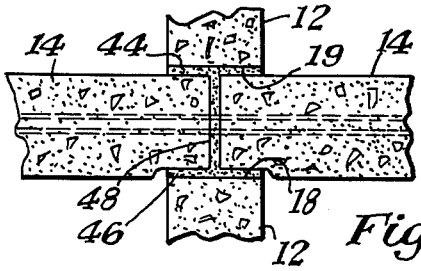
Fig. 1C.
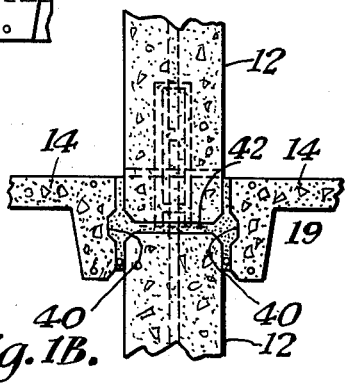
Fig. 1B.

ARCHITECTURAL SYSTEM HAVING POST-TENSIONED ELEMENTS

RELATED APPLICATION

This application is related in certain aspects to my copending application filed June 10, 1974 and entitled Architectural Constructional System, Ser. No. 477,983.

The present invention relates to architectural systems and more particularly to systems of the character described having enhanced seismic and wind resistance.

The invention is directed to an improved building construction having unique load-carrying walls and partitions, together with floor/ceiling arrangements, particularly useful for modular or synergestic type construction. The walls, partitions, floors, and ceilings arrangements can be assembled unexpectedly into stabilized structural units which can be utilized repeatively in either a horizontal or vertical direction or both throughout a given building construction. A unique arrangement for typing the various structural systems of the building together, in both the horizontal and vertical directions, is provided for increased seismic and wind resistance. In particular the invention provides a building construction in which walls, partitions, ceilings and floors can be assembled quickly and with minimal expenditure of labor and materials, from either precast or on-site cast concrete slabs or the like. A synergistic building structure having many rooms arranged in a repetitive manner, such as motels, hotels, apartment dwellings and condominiums, can be constructed in this fashion.

Many attempts have been made in the past to prefabricate various types of repetitive structural units. Such units have suffered from lack of stability, particularly in multi-storeyed construction or have lacked self-supporting characteristics, or have otherwise been unwieldy in use. Conventional structural units usually require the use of mortar or other wet joints. The joints generally are not self-aligning, or otherwise require similar or other types of building units for their stabilized support. In contrast, my building construction is capable of free standing on a conventional foundation or other prepared support.

In order to overcome the various disadvantages of the prior art and to accomplish the aforedescribed aims of the invention I provide an architectural system comprising a number of free-standing wall modules of cruciform configuration, a bearing surface adjacent the end of each arm of said wall modules, a square or rectangular supporting beam network disposed with its corners engaging one of said bearing surfaces and having a number of side beam segments, and a floor/ceiling module supported on said beam arrangement, said cruciform wall modules being oriented and spaced from one another to define a floor area extending therebetween and having its perimetric edges angularly displaced about 45° relative to the perimetric edges of said beam network such that the floor area is substantially wider than the length of one of said beam segments.

I also desirably provide a similar architectural system wherein said beam network is formed integrally within an associated floor/ceiling module.

I also desirably provide a similar architectural system wherein said floor/ceiling module is provided with series of waffle areas, said waffle areas being displaced in said floor/ceiling module to provide said supporting beam network.

I also desirably provide a similar architectural system wherein each of said networks includes a number of beam segments, said beam segments extending longitudinally and transversely of said floor structure, the beam segments of each of said floor/ceiling modules being alignable respectively with beam segments of at least an additional one of said floor/ceiling modules.

I also desirably provide a similar architectural system wherein each aligned set of longitudinal or transverse beam segments of said floor/ceiling modules includes aligned channels extending axially therethrough, and post-tensioning cables or rods are inserted through each aligned series of said channels.

I am aware of the following U.S. Patents relating to various types of building constructions:

| | | | |
|---|---|---|---|
| Loucks | 2,134,637 | Wood et al | 2,309,149 |
| Smith | 2,326,503 | Justus | 2,902,733 |
| Bender | 2,930,222 | Walsh | 2,960,249 |
| Rose | 3,113,401 | Schmidgall | 3,166,802 |
| Nelson | 3,346,998 | | |

The foregoing patents, however, do not disclose either singly or in combination, the novel features of my invention as pointed out above.

During the foregoing discussion, various objects, features and advantages of the invention have been set forth. These and other features and advantages of the invention together with structural details thereof will be elaborated upon during the forthcoming description of certain presently preferred embodiments of the invention and presently preferred methods of practicing the same. In the accompanying drawings I have shown certain presently preferred embodiments of the invention and have illustrated certain presently preferred methods of practicing the same wherein:

FIG. 1 is a reflective ceiling floor plan view of one form of building construction arranged in accordance with the invention;

FIG. 1A is an enlarged, partial, sectional view of the architectural system of FIG. 1 and taken along reference line 1A—1A thereof;

FIG. 1B is an enlarged, partial, sectional view of the architectural system of FIG. 1 and taken along reference line 1B—1B thereof;

FIG. 1C is an enlarged, partial, sectional view of the architectural system of FIG. 1 and taken along reference line 1C—1C thereof;

Figure 2:
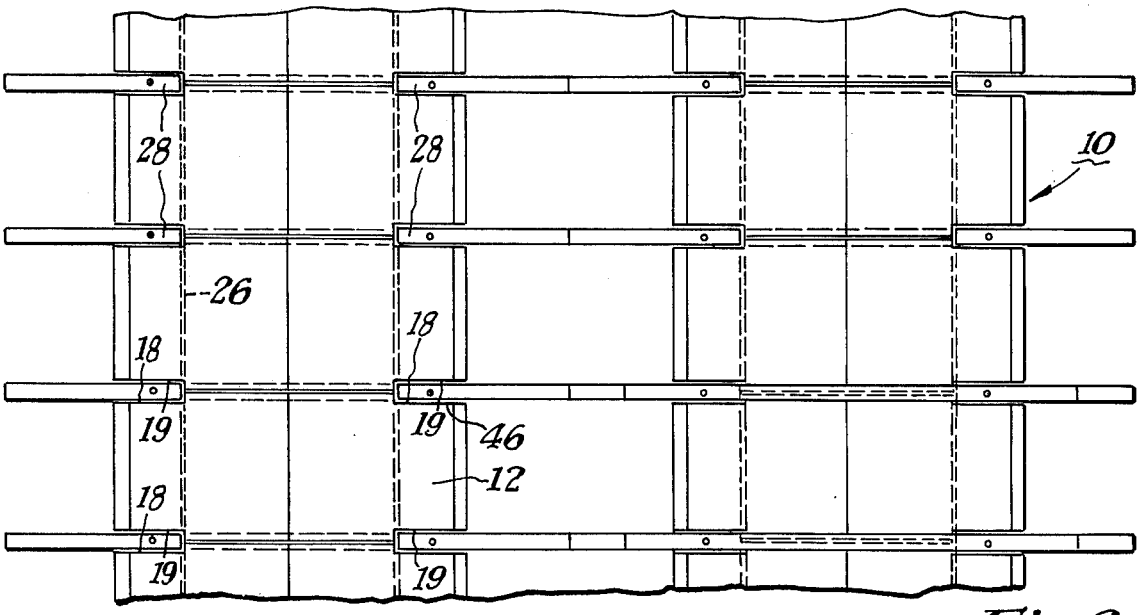
FIG. 2 is a front elevational view of a multi-storeyed building constructed from the architectural system of FIG. 1.
Figure 5:
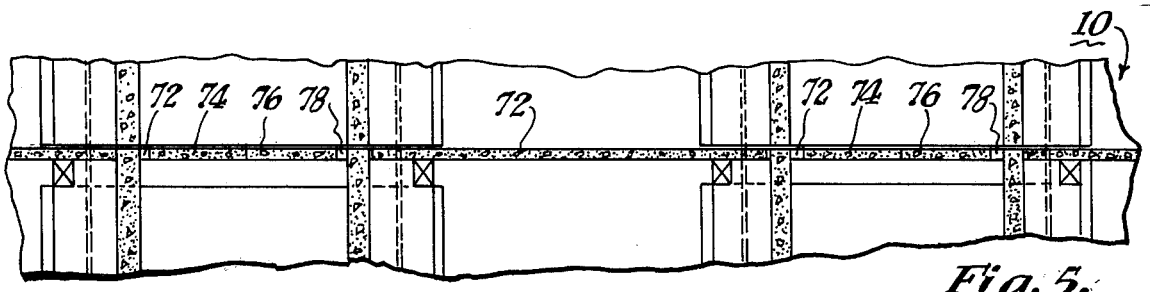
Figure 4:
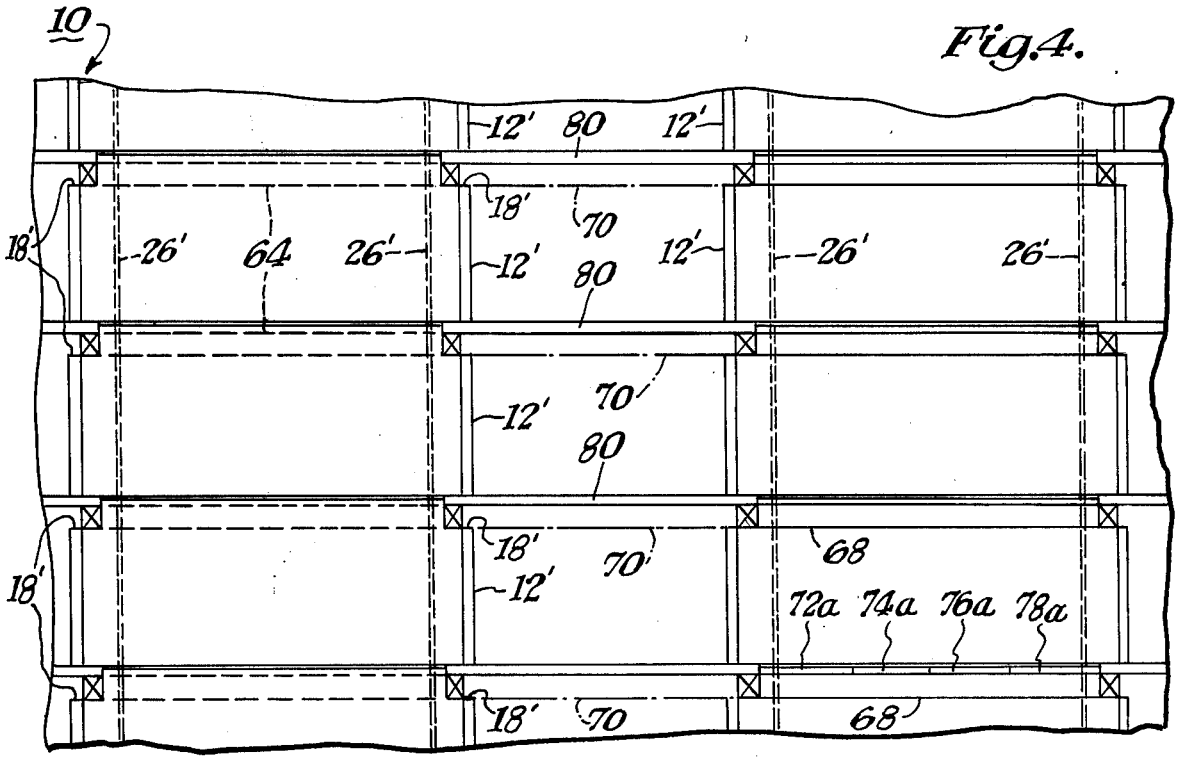
Figure 3:
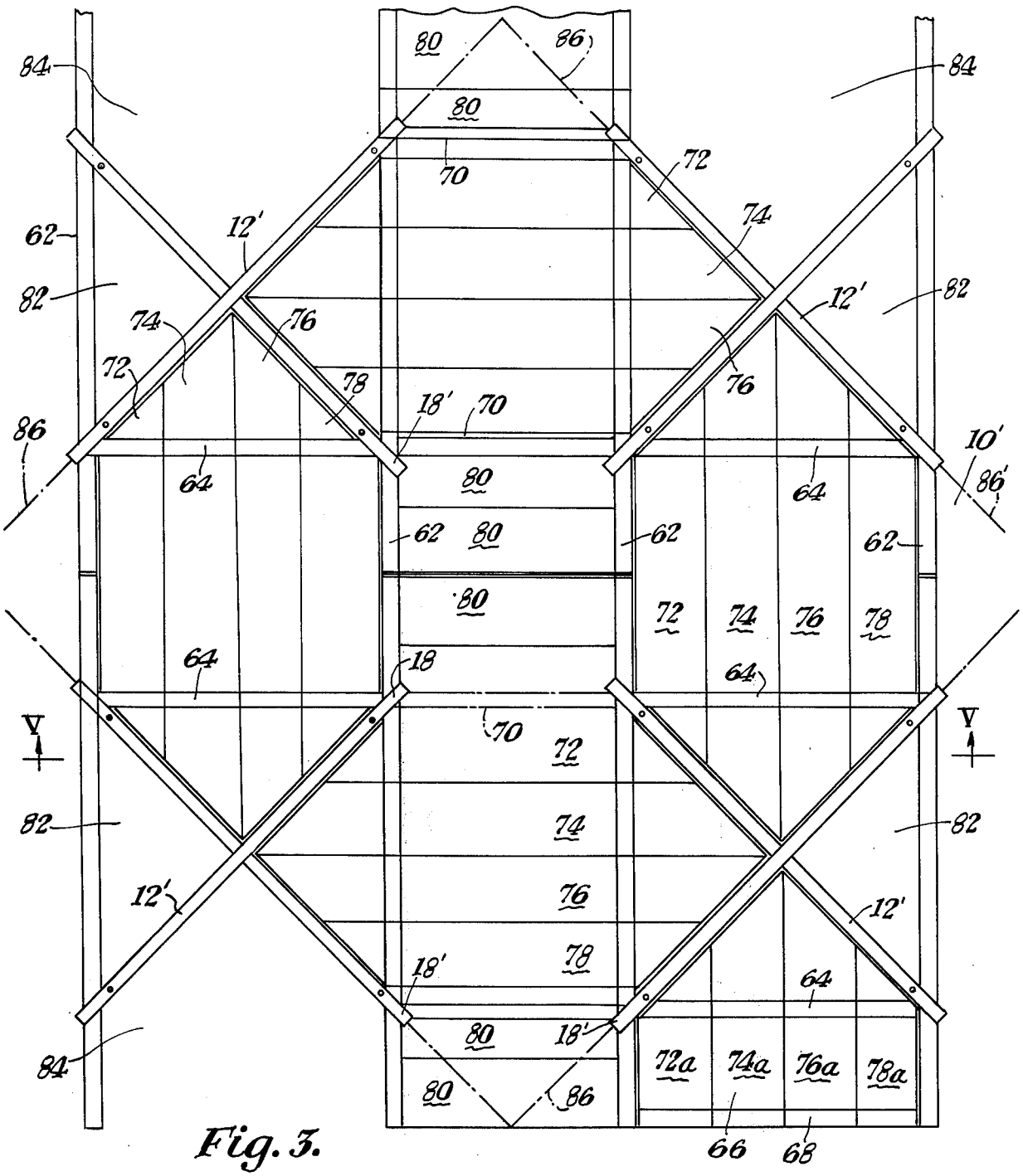
FIG. 3 is a plan view of another modification of the architectural system of the invention.

FIG. 4 is a front elevation of a multi-storeyed building constructed from the architectural system of FIG. 3; and, FIG. 5 is a partial, vertically sectioned view taken along reference line V—V of FIG. 3. With reference now more particularly to FIGS. 1–2 of the drawings, the exemplary architectural system 10 shown therein comprises a number of concrete vertical modules 12 and a number of concrete floor/ceiling modules 14.

Where balconies or similar structural arrangements are desired, modified floor/ceiling modules 16 additionally can be employed.

Each of the wall modules 12 can be formed from a pair of concrete panels assembled in a cruciform configuration as shown, after the manner of that described and claimed in my aforementioned copending application. However, as better shown in FIG. 2 each end portion of each panel is stepped at 18 to provide bearing areas for the floor/ceiling modules 14 or 16. Desirably the opposite edge portions of each of the panels are similarly stepped at 19 for manufacturing uniformity. When the wall modules 12 are assembled jack-over-jack as in FIG. 2 to form a mult-storeyed structure, the panel offsets or steps 18, 19 accommodate the width of the adjacent portions of the floor/ceiling modules 14, 16, plus the necessary or desirable shimming 44 and grouting 46 (FIG. 1C).

Depending upon the number of storeys desired and the requisite foundation, any appropriate number of the wall modules 12 can be assembled jack-over-jack, after the manner of FIG. 2. As better shown in FIG. 1 four series of jack-over-jack wall modules 12 are utilized for construction of the architectural system 10. It will be understood, of course, that a greater or lesser number of series of wall modules can be employed pursuant to the teachings of the present invention and of my aforesaid copending application. It will be readily apparent also that the architectural system 10 can be repetitive in the horizontal direction, as well as in the vertical, for construction of motels or other elongated structures.

Each arm of each cruciform wall module 12 is provided with a vertical channel 24, which is alignable with similar channels in the other wall modules when assembled jack-over-jack, for reception of vertical post-tensioning tendons 26 (FIG. 2). Although desirably disposed adjacent the ends of the panels forming the wall modules 12, the channels 24 and tendons 26 preferably are positioned to just clear the inserted portions 28 of the floor/ceiling modules 14 or 16. After assembly of the wall modules 12 and floor/ceiling modules 14 (and the floor/ceiling module 16 if used), the tendons 26 can be tightened by conventional post-tensioning devices (not shown).

In the architectural system 10, as illustrated, four of the floor/ceiling modules 14 of generally square or rectangular configuration are supported upon four of the wall modules 12 comprising each storey (FIG. 1). One or more additional floor/ceiling modules 16 can be supported from one or more of the wall modules 12, respectively, if one or more balconies or similar structures are desired for each storey of the architectural system 10.

The floor/ceiling modules 14, 16 desirably are of waffle configuration to provide the requisite superimposed loading with minimum weight, as evident from a comparison of FIGS. 1, 1A. The waffle pattern affords a grid of longitudinal and transverse beams 30, 32, in the conventional manner, each of which can be reenforced as shown in FIG. 1A. However, each waffle pattern of the entire floor area and denoted generally by reference numerals 34 is displaced from adjacent patterns to form additional and massive supporting beam segments 36, 38 extending respectively longitudinally and transversely of each floor/ceiling module. The massive beams segments 36, 38 (FIG. 1) of each floor/ceiling module 14, 16 is oriented so that their massive beam segments 36 or **36*a* and 38 or 38*a* are axially aligned throughout the entire floor area of each storey of the architectural system 10, including the balcony 16. The massive beam segments 36, 38 of each floor/ceiling module 14 are arranged in a square or rectangular array, whose perimeter is displaced about 45° relative to the perimeter of the module 14. In this way, beam segments 36, 38** cooperate to support a module having a width about 1.4 times the length of individual beam segments.

Again from FIG. 1 it will be apparent that the corners or junctions of the array of massive beam segments 36, 38 of each floor/ceiling module 14 or 16 rests upon the stepped portions 18 of the associated wall modules 12. The larger floor/ceiling modules 14 are thereby provided with a four-point support, where the adjacent portions of the modules 14 are inserted between or otherwise supported on the offset portions 18, 19 of the jack-over-jack wall modules 12. Similarly the triangular floor/ceiling module 16 is provided with a two-point support. It will also be observed that each support area of the floor/ceiling modules occurs in areas of the junctions of its own massive beam segments 36, 38 or **36*a* or 38*a***, and thateach of these junctions also are alignable with similar junction of adjacent floor/ceiling modules.

The floor/ceiling modules 14, 16 desirably are provided with grouting grooves 40 (FIG. 1B) at those edge portions where the floor/ceiling modules make non-bearing contact either with one another or with the wall modules 12. As also evident from FIG. 1B the wall modules 12 can be assembled jack-over-jack and spaced properly relative to the thickness of the floor/-ceiling modules 14, 16 through the use of suitable shimming material 42 inserted directly between the wall modules 12. Where the floor/ceiling modules 14, 16 are bearingly supported on the wall modules 12, the shimming and grouting arrangement of FIG. 1C can be employed, with shimming material 44, 46 and grouting 48 employed in the requisite thicknesses.

Figure 1D:
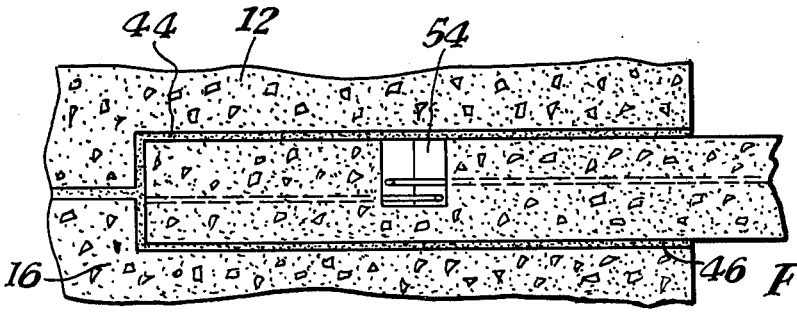
FIG. 1D is an enlarged, partial, sectional view of the architectural system of FIG. 1 and taken along reference line 1D—1D thereof.

Comparing now FIGS. 1, 1A and 1B it will be seen that each of the massive beam segments 36, 38 or **36*a* is provided with a central channel 50 or 52 extending axially therethrough. The channels 50, 52 are so disposed and the floor/ceiling modules 14, 16 are so oriented that the channels 50 are axially aligned with one another transversely of the floor area of each storey, while the channels 52 are similarly aligned longitudinally thereof. At the edges of the floor/ceiling modules 14, 16, the beam segment channels 50 or 52 open into a V-shaped troughs 54. The V-shaped troughs 54. The V-shaped troughs 54 as evident from FIGS. 1, 1D in turn open onto the top surfaces of the floor/ceiling modules 14, 16 pairs of the V-shaped troughs 54 cooperate to form a cruciform recesses as evident from FIG. 1.**

After installation of the requisite floor/ceiling modules 14, 16 of each storey of the architectural system 10, post-tensioning cables or rods 56, 58 are inserted transversely and longitudinally of the entire floor area, through the aligned channels 50, 52 respectively. Suitable post-tensioning devices (not shown) of a conventional nature can be inserted into those V-shaped troughs **54*a* at the outer perimeter of the floor area of each storey of the architectural system 10. At the hypotenus edge of the floor/ceiling panel 16 conical recesses 60 communicating with the post-tensioning channels 50*a* can be provided for the same purpose. In this manner, the floor/ceiling modules 14, 16 of each storey can be bound together after installation and stabilized horizontally by the post-tensioning cables or rods 56, 58. It is appropriate to observe at this point that the architectural system 10 can be stabilized both vertically and horizontally by the post-tensioning devices respectively associated with its wall modules 12 and its floor/ceiling modules 14, 16.**

The cruciform recesses 54, 54*a* facilitate passing the transverse and longitudinal cables or rods or other tensioning devices 56, 58 over or under one another at points of their crossing throughout the floor area. After the horizontal post-tensioning cables and devices are installed and tightened, the V-shaped troughs 54, 54*a* and the conical recesses 60 can be filled with grouting material or the like.

It will be apparent that the integral massive beam segments 36, 38 of the floor/ceiling modules 14 can be omitted and that an external, square or rectangular beam arrangement such as that shown in FIGS. 3–5 can be substituted. In that case, it may be desirable to employ a dropped ceiling to cover the external beam construction. A dropped ceiling can also be used in the FIG. 1 arrangement, for decorative or other purposes. Use of an external beam construction can also be employed with the aforedescribed horizontal post-tensioning.

Another arrangement of my novel architectural system 10′ is illustrated in FIGS. 3–5 of the drawings. The architectural system 10′ also includes a number of series of jack-over-jack wall modules 12′, with four vertical series being employed in this arrangement of the invention. As noted previously a different number of series of wall modules 12′ can be employed depending upon the horizontal extent of the building construction 10′.

The wall modules 12′ are similar to the wall modules 12 of the preceding figures and are likewise provided with post-tensioning devices 26′. Stepped portion 18′ of each arm of the wall module 12′ can be considerably shorter for reasons apparent from the following description.

The stepped portions 18′ of the wall modules 12′ support a number of steel I-beams 62 or the like extending longitudinally of the floor area of each storey of the architectural system 10′. Similar beams 64, although shorter in length, are extended between each pair of the longitudinal beams 62, and are joined in the usual fashion thereto, preferably adjacent points of their bearing contact with the wall modules 12′. Where a balcony arrangement 66 or the like is provided an additional transverse beam 68 is extended between the cantilevered ends of the associated longitudinal beams 62. Desirably a number of tie beams 70 can be extended between the inward pair of longitudinal beams 62.

The steel supporting structure thus formed supports a number of floor slabs, preferably of reenforced concrete, of each storey of the architectural system 10′. For example the four hexagonal areas partially enclosed between the adjacent arms of the cruciform wall modules 12′ can be covered by four angle-cut reenforced concrete slabs 72, 74, 76 and 78. Each of the slabs 72–78 is of suitable length to extend extirely between the juxtaposed wall modules 12′ and is supported by a spaced pair of the longitudinal beams 62 or of the transverse beam 64, as evident from FIG. 3. Half-length slabs 72*a*, 74*a*, 76*a*, 78*a* can be utilized for the balcony area 66, where they are each supported by the cross beams 64, 68. Preferably each of the slabs 72*a* –78*a* are tied down to the outer cross beam 68.

The remaining areas of the floor or each storey can be filled in by rectangular concrete slabs 80. The four triangular areas 82, which are not covered by floor slabs, can be utilized for elevator shafts or for utility service. If desired the remaining pentagonal areas 84 can be employed alternatively as elevator shafts, utility service, or for additional balconies. In the latter case additional floor slabs 72*a*–78*a* can be added. In the aforedescribed floor slab arrangement and steel support can be repeated for each storey of the architectural system 10′ as evident from FIG. 4.

It will be evident that each series of the floor slabs 72–78 constitute a floor/ceiling module supported on a square or rectangular, external beam network comprising a pair of the cross beams 64 or 70 and the adjacent lengths of a pair of the longitudinal beams 62. It will also be evident that a single continuous floor module of square or rectangular configuration can be substituted for each set of floor slabs 72–78 as denoted by chain outlines 86 thereof (FIG. 3). In that case all of the floor slabs of FIG. 3 can be replaced by four floor/ceiling modules 86, with the exception of the balcony slabs 72*a*–78*a*. The floor/ceiling modules 86 can be configured similar to the floor/ceiling modules 14 of FIGS. 1–2, with the exception that the massive beam segments 36, 38 thereof can be omitted. For example, the floor/ceiling modules 86 can be provided with a continuous waffle network.

From the foregoing it will be seen that a novel and efficient architectural constructional system has been described herein. The descriptive and illustrative materials employed herein are utilized for purposes of exemplifying the invention and not in limitation thereof. Accordingly, numerous modifications of the invention will occur to those skilled in the art without departing from the spirit and scope of the invention. Moreover, it is to be understood that certain features of the invention can be used to advantage without a corresponding use of other features thereof.

I claim:

1. An architectural structure comprising a number of free-standing wall modules of cruciform configuration having arm portions extending therefrom and forming bearing wall sections each extending from a floor to a juxtaposed ceiling of said structure, an upper bearing surface adjacent the end of each of said arm portions, a square or rectangular supporting beam network disposed with each of its corner sections engaging one of said bearing surfaces, and a substantially self-supporting floor/ceiling module supported on said beam arrangement and substantially coinciding with a given floor area, said cruciform wall modules being oriented and spaced from one another to define said given floor area as extending therebetween and having its perimetric edges angularly displaced relative to otherwise corresponding perimetric edges of said beam network such that the total floor or ceiling area of said floor/ceiling module is substantially larger than a total corresponding area enclosed by said beam network and so that at least one corner portion of said floor/ceiling module is supported in cantilever fashion with respect to said wall modules and said beam network.

2. The combination according to claim 1 wherein said beam network is formed integrally within said floor/ceiling module.

3. The combination according to claim 2 wherein said floor/ceiling module is provided with series of waffle areas, said waffle areas being displaced from one another in said floor/ceiling module to form relatively narrow areas of substantially uniform thickness within said floor/ceiling module, said narrow areas extending substantially between perimetric edges of said floor/-ceiling module in provision of said supporting beam network.

4. The combination according to claim 3 wherein the perimetric edges of one of said waffle areas are substantially aligned with the perimetric edges of said beam network.

5. The combination according to claim 2 wherein longitudinaland transverse beam segments of said floor/ceiling module each includes at least one channel extending axially therethrough, and post-tensioning cables or rods are inserted respectively through said channels.

6. The combination according to claim 1 wherein horizontally displaced series of said wall modules are mounted respectively jack-over-jack, and each level of said series supports a beam and floor/ceiling structure to form a multi-storeyed architectural structure.

7. The combination according to claim 6 wherein a number of post-tensioning cables or rods are passed through aligned vertical channels therefore in each vertical series of said wall modules.

8. The combination according to claim 7 wherein said channels and rods or cables extend through each arm of said wall modules adjacent the outward ends thereof.

9. The combination according to claim 2 wherein a plurality of beam networks and floor/ceiling modules respectively thereon are provided and are disposed substantially in a given horizontal plane to form a continuous floor structure.

10. The combination according to claim 9 wherein each of said networks includes a number of beam segments, said beam segments extending longitudinally and transversely of said floor structure, the beam segments of at least one of said floor/ceiling modules being longitudinally alignable respectively with beam segments of at least an additional one of said floor/ceiling modules.

11. The combination according to claim 10 wherein each aligned set of longitudinal or transverse beam segments extending in tandem through at least two of said floor/ceiling modules includes aligned channels extending axially and respectively therethrough, and post-tensioning cables or rods are inserted through each aligned series of said channels, whereby a number of said floor/ceiling modules can be post-tensioned together and simultaneously.

12. The combination according to claim 11 wherein a cruciform recess is formed in said floor/ceiling modules at each point of crossing of said cables or rods, said recesses opening transversely onto floor surfaces of said floor/ceiling modules.

13. The combination according to claim 1 wherein said floor/ceiling module is angularly displaced about 45° relative to said beam network.

14. The combination according to claim 1 wherein said cantilevered corner portion substantially coincides with a corner area defined by a juxtaposed one of said wall modules.

15. The combination according to claim 1 wherein a plurality of beam networks and floor/ceiling modules are provided and are disposed relative to a given horizontal plane to form a continuous floor structure.

* * * * *